US007114288B1

(12) United States Patent
Kershaw

(10) Patent No.: US 7,114,288 B1
(45) Date of Patent: Oct. 3, 2006

(54) PLANTER CADDY

(76) Inventor: Thomas Kershaw, 5626 Riverside Dr., Cape Coral, FL (US) 33904

( * ) Notice: Subject to any disclaimer, the term of this patent is extended or adjusted under 35 U.S.C. 154(b) by 0 days.

(21) Appl. No.: 11/096,431

(22) Filed: Apr. 4, 2005

(51) Int. Cl.
*A47G 7/00* (2006.01)

(52) U.S. Cl. ..... 47/39

(58) Field of Classification Search ..... 47/71, 47/39, 44, 46, 47, 65.6, 80; 220/630; 248/346.11, 248/129; 280/33.998, 79.11, 79.2, 79.5; D7/624.1; D11/164; D34/23; 108/53.5
See application file for complete search history.

(56) References Cited

U.S. PATENT DOCUMENTS 585,931 A * 7/1897 Gridley ..... 47/39
590,282 A * 9/1897 Smiser ..... 280/640
603,492 A * 5/1898 Waterer ..... 47/65.6
2,206,694 A * 7/1940 Greene ..... 47/71
2,707,351 A * 5/1955 Walker ..... 47/39
3,972,419 A * 8/1976 Short ..... 211/78
5,094,031 A * 3/1992 Lee ..... 47/39
D349,995 S * 8/1994 Cassel et al. ..... D34/23
D361,308 S * 8/1995 Loran ..... D11/164
5,445,396 A * 8/1995 Sebor ..... 280/33.998
5,819,469 A * 10/1998 Hsu ..... 47/39
D455,675 S * 4/2002 Rose ..... D11/164
6,655,084 B1 * 12/2003 Missry ..... 47/71
2002/0174599 A1 * 11/2002 Rose ..... 47/65.6
2005/0081439 A1 * 4/2005 Lehman et al. ..... 47/39

* cited by examiner

*Primary Examiner*—Francis T. Palo

(57) ABSTRACT

A planter's caddy that can be rotated and moved to different locations by way of five casters having dual wheels. The casters are mounted on an underside of the caddy which consists and is constructed as one unit. The unit has a circular top surface that is slanting downwardly toward its periphery. The top surface also has a multiple of upstanding ribs thereon. Each of the ribs has a top edge. All of the top edges form a planar surface that is oriented in a horizontal plane relative to the slanting top surface. The upstanding ribs are radiating outwardly from a center of the top surface toward a periphery of the top surface. At the periphery there is downwardly depending skirt.

5 Claims, 2 Drawing Sheets

PLANTER CADDY

FIELD OF THE INVENTION

The invention is directed to the support or display of plants that are on display in any location and are movable to different locations by movable caddys or dollies if one so desires. The different areas could be to follow the sunshine or any shade depending on the plants involved. It is also desirable to turn the plant so that different sections of the plant can be exposed to either sunshine or shade. Some plants are rather large and are cumbersome to be moved by picking them up or by sliding them on a support. The inventive plant caddy improves the movement of plants that are planted in a container.

BACKGROUND OF THE INVENTION

There are a large number of wheeled plant pots that can be moved from one location to another.

U.S. Pat. No. 1,859,352 discloses a plant support that is rotating on a stationary base but cannot be wheeled to different locations. The plant support operates on the wheel principle of a "Lazy Susan"

U.S. Pat. No. 3,528,676 illustrates a movable container for flower pots which can be wheeled to different locations. The flower pot is disposed on top of ribs 11 that provide a ventilation area under the pot and to collect water therein.

U.S. Pat. No. 5,094,031 shows a wheeled plant pot that can be moved to different locations by way of casters attached to a bottom of the caddie. The flower pot is merely supported by an upper surface of the dolly or caddy.

U.S. Pat. No. 5,321,909 discloses a plant pot support for protecting a substrate, that is, a floor on which the plant is to placed. There are a multiple of radiant ribs, among others, to form a space between a bottom of the container and the substrate.

U.S. Pat. No. 5,819,469 shows a support plate for flower pots in which water is stored and hidden between an upper plate element and a lower plate element. The plant support has casters thereon so that the caddy can be moved to different locations.

U.S. Pat. No. 6,128,854 illustrates a potted plant turntable that can be programmed to turn the turntable at various time intervals so that the plant can evenly be disposed to sunshine.

U.S. Pat. No. 6,128,853 discloses a ball wheeled planter consisting of a deep container to collect water therein.

U.S. Pat. No. 6,655,084 shows a planter caddy including a frame having a support surface. The frame has caster wheels thereon. A plastic tray includes four recessed pockets. The plastic tray is supported on the support surface of the frame and receives a potted plant thereon.

BRIEF DESCRIPTION OF THE INVENTION

The invention consists of a single unit having five casters on its underside. The top surface of the unit is somewhat slanted downwardly toward its outer radius or periphery and has a depending skirt surrounding the unit. On the slanting top surface of the unit there are provided a multiple of ribs radiating outwardly toward the skirt of the unit.

The top edges of all of the ribs exhibit a planar surface that is oriented horizontally relative to the slanting of the top surface of the unit. This way, any water running out of the flower pot standing on top of the ribs can exit from underneath the pot downwardly toward the circumference of the unit and between the ribs.

DETAILED DESCRIPTION OF THE INVENTION

Figure 1:
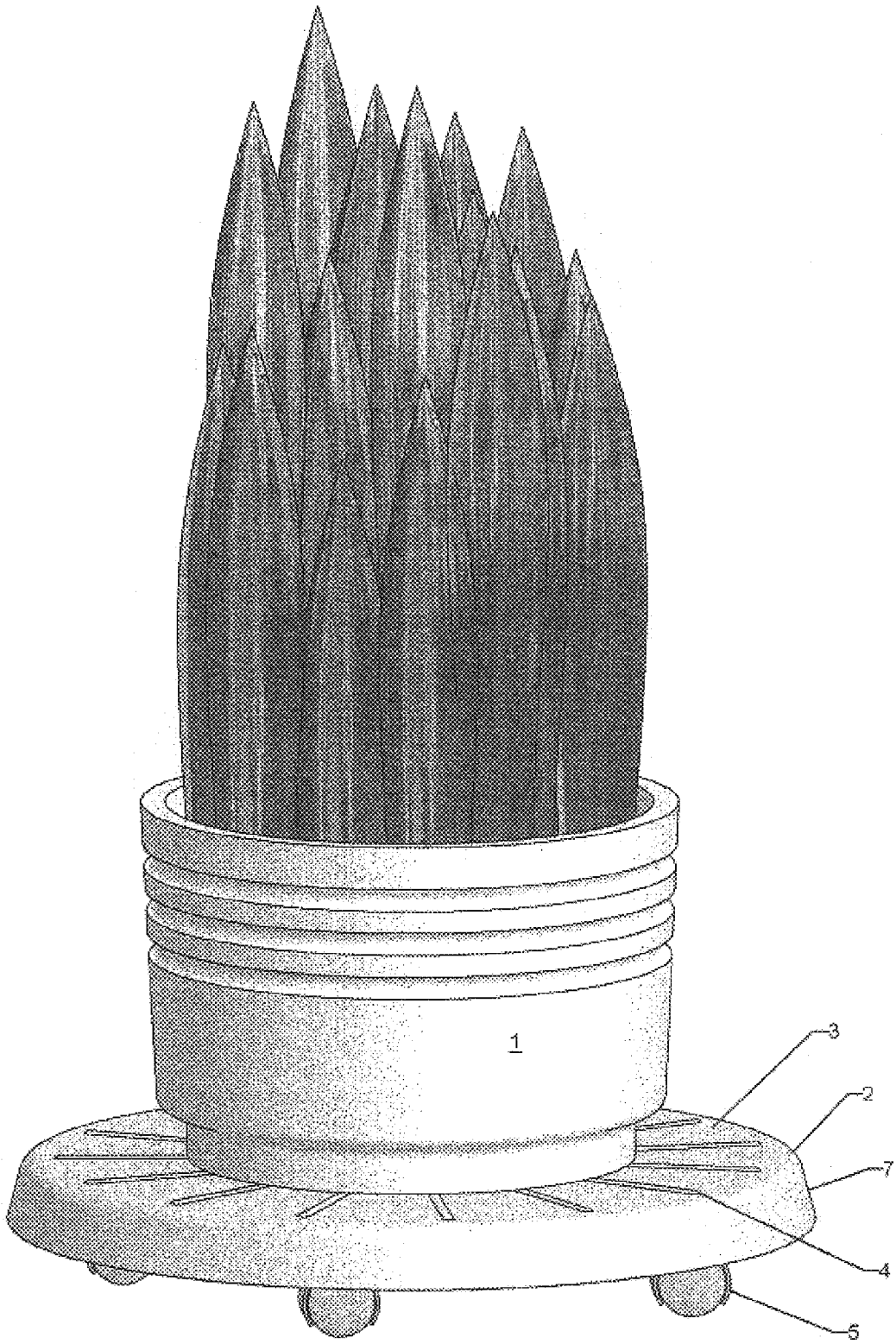
FIG. 1 is a perspective view of the planter caddy with a flower pot on top.

FIG. 1 shows the flower pot or planter 1 placed on top of the caddy or unit 2. The unit has a top surface 3 which is slanting downwardly toward its circumferential edge (to be explained below). At the edge of the top surface 3 there is a depending skirt 7. Also shown in FIG. 1 are upstanding ribs 4 which will receive the planter 1 to support the same. There are casters 5 which will give the caddy a rolling or rotating support.

Figure 2:
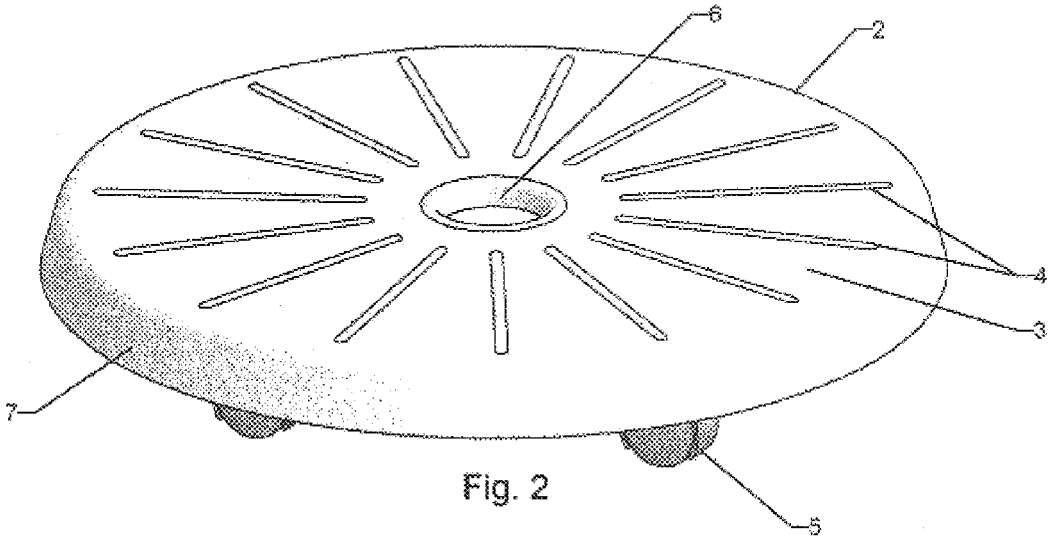
FIG. 2 is a perspective view of a top surface of the planter caddy.

FIG. 2 is a perspective view of the solitary unit of the caddy without the planter placed on top. The same reference characters have been applied as were in FIG. 1. The center of the circular caddy has a central opening 6 therein on its top surface.

Figure 3:
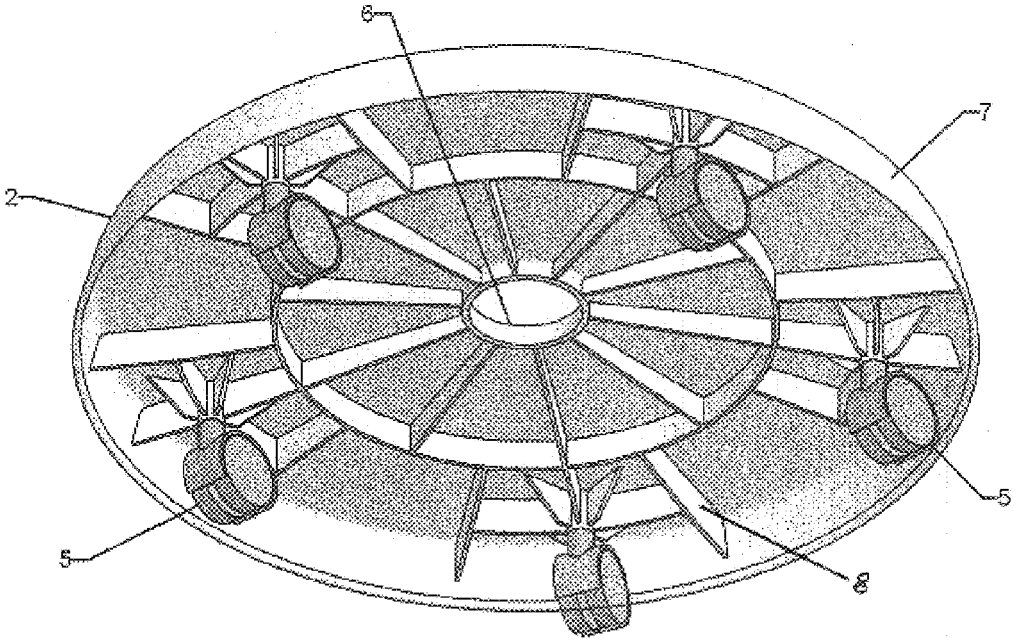
FIG. 3 is a perspective view of the underside surface of the planter caddy.

FIG. 3 illustrates the planter caddy from its underside and again the same reference characters have been applied as were shown in FIGS. 1 and 2. The planter caddy may be molded as a single unit with reinforcing stays 8 on the undersurface of the caddy. The caddy may be molded from PVC including a sunlight inhibitor to assure a lasting appearance and function of the caddy. There is nothing to rust, discolor or disturb the lasting appearance and appeal of this caddy. Also shown in FIG. 3 are five swivable casters 5 to enable the planter caddy to be rotated or moved to a different location. The multiple dual wheel casters are made of high impact molded resin which is rated to hold a total of 250 lbs. The five caster design assures ease of moving the largest planters without any struggle and a threat of toppling.

Figure 4:
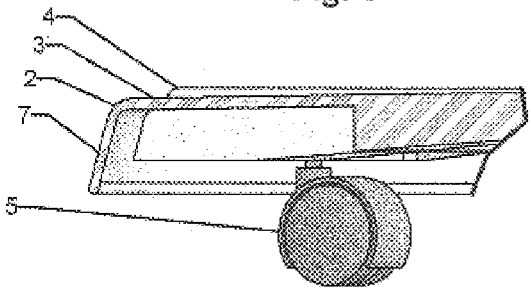
FIG. 4 is a cross section through an edge of the planter caddy.

FIG. 4 shows the relationship of the upstanding ribs 4 relative to the top surface of the unit. As can be seen, the unit 2 is of a solid configuration but the top surface 3 is somewhat slanting downwardly toward its circumferential edge where the downwardly extending skirt 7 is located. The edges of the upstanding ribs 4 form a planar surface which is oriented horizontally relative to the slanting or sloping top surface 3 of the caddy. The combined horizontal edges of the ribs form a planar support surface to receive the underside of a planter to provide a firm and secure support for the planter. As is well known, substantially all planters have orifices through their bottoms to allow excess water to drain there through.

Because of the fact that the top surface of the caddie is slanted downwardly, the excess water draining from the planter, 1 can run off the top surface 3 of the caddy toward its outer circumference. The area between the upstanding ribs 4 provide a channel to aid in draining the water.

The underside of the caddy is designed with an array of strengthening ribs 8 and substantial caster mounting supports. Open spaces between the casters permit two caddy units to be stacked back to back for limited packaging height as the casters will nest within provided pocket areas.

What I claim is:

1. A planter caddy adapted to receive a planter on a top surface, said caddy is constructed as a single unit, said top surface is slanting downwardly from a top center toward a periphery of said top surface, said surface furthing having a multiple of upstanding ribs having top edges radiating outwardly from said center of said top surface toward said periphery, said edges of said ribs are oriented in a horizontal plane relative to said slanting top surface, and said caddy further having a plurality of casters located on an underside of the caddy.

2. The planter caddy of claim 1, wherein there are at least five casters are located on said underside of said planter caddy.

3. The planter caddy of claim 1, wherein said caster casters are dual wheel casters.

4. The planter caddy of claim 1 including a skirt depending downwardly from said periphery of said top surface.

5. The planter caddy of claim 1 including reinforcing ribs located on an underside of said top surface.

* * * * *